US006658981B2

(12) United States Patent
Rochen et al.

(10) Patent No.: US 6,658,981 B2
(45) Date of Patent: Dec. 9, 2003

(54) THRU-TUBING STACKABLE PERFORATING GUN SYSTEM AND METHOD FOR USE

(75) Inventors: James A. Rochen, Waller, TX (US); Kare-Jonny Haugvaldstad, Stavanger (NO); Timothy W. Sampson, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 170 days.

(21) Appl. No.: 09/771,739

(22) Filed: Jan. 29, 2001

(65) Prior Publication Data

US 2002/0100360 A1 Aug. 1, 2002

(51) Int. Cl.[7] ..... B64D 1/04

(52) U.S. Cl. ..... 89/1.15; 166/297; 166/298; 166/299

(58) Field of Search ..... 89/1.15; 166/297, 166/298, 299, 308, 118

(56) References Cited

U.S. PATENT DOCUMENTS

| | | | | | |
|---|---|---|---|---|---|
| 2,986,214 | A | * | 5/1961 | Wiseman, Jr. et al. | 175/4.52 |
| 3,891,034 | A | | 6/1975 | Owen et al. | 166/285 |
| 5,042,594 | A | * | 8/1991 | Gonzalez et al. | 89/1.15 |
| 5,366,014 | A | | 11/1994 | George | 166/297 |
| 5,458,196 | A | | 10/1995 | George et al. | 166/298 |
| 5,678,635 | A | | 10/1997 | Dunlap et al. | 166/387 |
| 5,785,125 | A | | 7/1998 | Royer | 166/380 |
| 5,992,289 | A | * | 11/1999 | George et al. | 89/1.15 |

* cited by examiner

*Primary Examiner*—J. Woodrow Eldred
(74) *Attorney, Agent, or Firm*—Madan, Mossman & Sriram, P.C.

(57) ABSTRACT

A stackable thru-tubing perforating gun system for use in perforating in a large diameter cased wellbore below a smaller diameter production tubing string. The system comprises a thru-tubing retrievable bridge plug for supporting a lower perforating gun section. The system further comprises at least one additional gun section stacked on top of the lower gun section. After firing, individual gun sections may be retrieved from the wellbore through the tubing string.

6 Claims, 2 Drawing Sheets

THRU-TUBING STACKABLE PERFORATING GUN SYSTEM AND METHOD FOR USE

BACKGROUND OF THE INVENTION

1. Field of the Invention

This invention relates to apparatus and methods for perforating wells, and more particularly, to a stackable gun system and method of use utilizing a plurality of perforating guns which may be individually positioned in a wellbore and individually removed therefrom.

2. Description of the Related Art

In the past, perforating systems for use in completing or reworking wells have been run into wells on a pipe string or wire line and positioned and supported on a hanger. Another method for positioning the perforating assemblies entails running them into the well on a slick line and lowering them to the desired position in the well, where they are anchored to the well casing. The slick line is typically detached and removed from the perforating assembly before the perforating operation.

It is preferable to seat one or more perforating guns on a hanger or anchor that has been lowered and set in the casing at the desired depth. After the perforating guns are in position, the lowering equipment can be removed from the vicinity of the perforation, or from the well entirely. Thus the amount of unnecessary equipment in the vicinity of the perforation is minimized.

Conventional hangers, however, must be run into the well before any tubing string is installed because the hangers are typically too large to pass through a tubing string. If a tubing string is already in place in a well, as in the case of a well being reworked, it is difficult to position a hanger in the casing below the end of the tubing string without first removing the tubing string. Removal of the tubing string is undesirable, particularly in cases where the tubing string comprises expensive pipe and/or connections and it is preferred to keep the handling of the string to a minimum. In such cases, a wireline which can be either a slick line or a braided electric line can be used to lower individual perforating guns through the tubing to the desired depth. The disadvantage to using a wireline is that each gun is fired separately, resulting in pressure and flow from the formation begin as soon as the first gun is fired. This can greatly prolong the perforating operation.

Hence, there is a need for stackable perforating gun system that can be run through the production tubing, anchored in the larger casing below the end of the tubing string, fired as a unit and retrieved from the well after firing.

The system should be able to support several perforating guns, so that a desired length of pipe can be perforated simultaneously. The system, including the hanger and the individual gun sections, should also be self-centering in the casing, with the centralizers also being passable through the tubing string. If the gun system components do not centralize in the casing, it will be difficult or impossible to mate the individual sections for proper operation.

After perforation, the perforating guns can either be retrieved or dropped to the bottom of the well, depending on several factors. Hence, a support should be adaptable either to maintain its position in the casing or to release itself from the casing and drop to the bottom upon perforation. Other objects and advantages of the invention will appear from the following description.

SUMMARY OF THE INVENTION

The present invention provides a stackable perforating gun system in which a plurality of gun sections or sections may be individually run through production tubing, positioned in a wellbore, fired as a unit, and individually retrieved, as necessary. This tool can be run on coiled tubing, slick line or braided electrical wireline.

The stackable perforating gun system of the present invention may be described as a well perforating apparatus comprising a through tubing retrievable bridge plug engagable with a portion of a cased wellbore for providing a gun support within the wellbore, and a plurality of perforating gun sections, one of the gun sections being supported by the retrievable bridge plug. The remainder of the gun sections are supported by an adjacent gun section. Each gun section is centralized at each end with a coil spring actuated folding arm type centralizer which is passable in either direction, through the production tubing.

In one embodiment, the bridge plug is an automatically releasing bridge plug.

The invention may also be said to include a method of perforating a casing of a well, wherein the method comprises the steps of lowering a through tubing retrievable bridge plug through a production tubing and into the enlarged casing section below the bottom of the production tubing. Energizing the bridge plug such that the bridge plug fixedly engages the casing. Lowering a first perforating gun section into the casing, supporting the first perforating gun section in the casing on the retrievable bridge plug adjacent to a first portion of a subsurface formation to be perforated, lowering an additional perforating gun section into the casing, supporting the additional perforating gun section on the first perforating gun section adjacent to another portion of the subsurface formation, and firing the perforating gun sections and thereby perforating the casing. The step of lowering an additional perforating gun section into the casing may be repeated as many times as necessary or desired. That is, the additional perforating gun section may be one of the plurality of additional perforating gun sections, each of the additional gun sections being supported on an adjacent perforating gun section.

The method may further comprise a step of retrieving at least one of the perforating gun sections from the casing and may further comprise a step of retrieving the retrievable bridge plug.

The method may further comprise releasing the bridge plug from engagement with the casing after firing the perforating gun sections, thereby allowing the gun system to drop to the bottom of the hole.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

Advances in technology relating to workover of producing oil and gas wells have greatly enhanced the efficiency and economy of workover operations. Some workover operations can now be performed through a production string of a flowing oil and gas well. Previously, it was typical to remove the production tubing string to perform workover operations. This process of removing the production tubing is expensive, complicated, and time-consuming.

Figure 1:
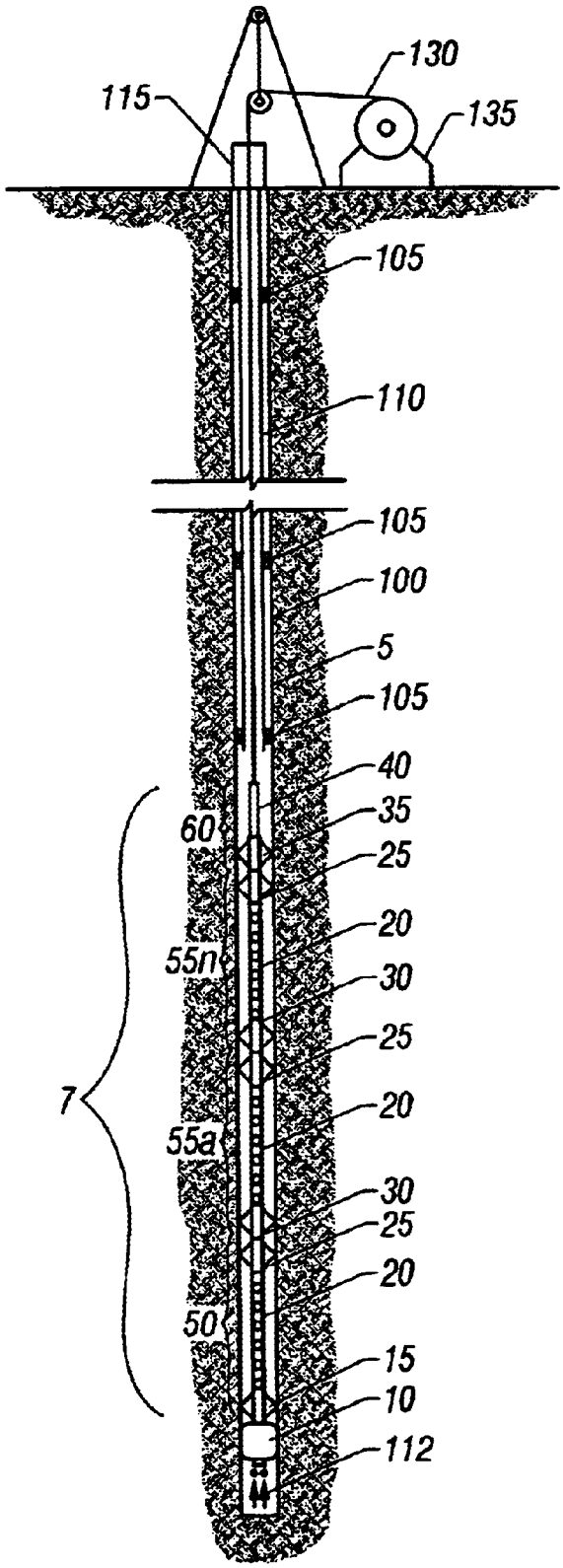
FIG. 1 is a schematic of a production wellbore with a stackable perforating gun system installed.

FIG. 1 shows a schematic diagram of a thru-tubing stackable gun system 7 deployed in a producing wellbore 5. The wellbore 5 has steel casing 100 which is cemented into the wellbore 5 using techniques known in the art of completion of wellbores.

The casing 100 extends from the wellhead 115 at the surface downward past the area to be worked over. Disposed within the casing 100 is at least one string of production tubing 110. The production tubing 110 is positioned in the wellbore by packers 105 seal off between the production tubing 110 and the casing 100 such that all production flow 112 is constrained to flow through the production tubing 110 to the surface. Such packers are known in the art and are not discussed in detail here.

A thru-tubing retrievable bridge plug 10 such as Baker Oil Tools Product No. H340-10, is run through the tubing 110 and set within the casing 100 near the bottom of the reservoir zone to be perforated.

The perforating gun system 7 operatively engages and is supported by the bridge plug 10. The gun system 7 comprises a plurality of gun assemblies, or sections. The lowermost gun section 50 comprises an upper centralizer 25 and a lower centralizer 15 for centralizing the gun 20 in the casing 100. The lower centralizer 15 is adapted to mate with the top of the bridge plug 10, using a collet type latching system known in the art.

Figure 2:
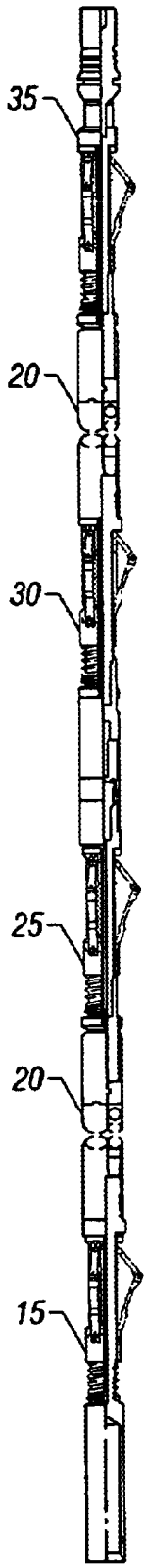
FIG. 2 is a schematic of one embodiment of a stackable perforating gun system; and, FIG. 3 is a schematic of a coil spring activated centralizer mechanism according to one embodiment.

At least one second gun section 55*a* is adapted to operatively connect with upper centralizer 25, as shown in FIG. 2. Second gun section 55*a* is operatively connected to lower gun section 50 so that when the upper gun section is fired, the lower gun section is fired sequentially. The operative connection between the gun sections is of a kind known in the art. The second gun section has a top centralizer 25 identical to the one on top of the lower gun section 50. Multiple gun sections 55*a*–55*n* may be stacked above lower gun section 50 and supported by bridge plug 10. The exact number of additional gun sections will vary depending on the well conditions and the size of the formation to be perforated.

Figure 3:
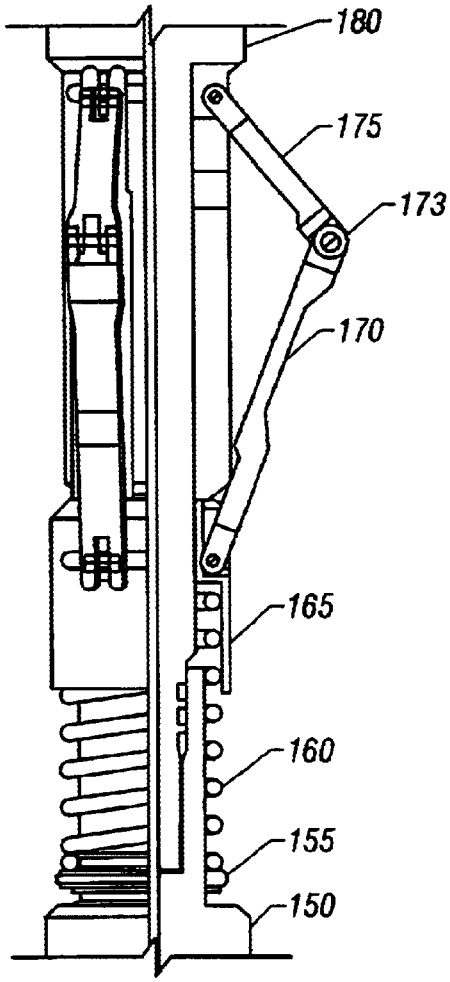

FIG. 3 is a schematic of the coil spring activated centralizer mechanism used in centralizers 15, 25, 30, and 35. The centralizer mechanism is the same in all of the centralizers with the centralizer ends being appropriately adapted to mate with other gun system components as necessary. The centralizer mechanism comprises an upper body 180 and a lower body 150 which are screwed together. A sliding spring cap 165 is sized to slide on the upper body 180. A coil spring 160 is captured between the sliding cap 165 and the spring stop 150. At least three equally spaced upper arms 175 are rotatably attached to the upper body 180. At least three lower arms 170 are rotatably attached to the sliding cap 165 and are pinned to the upper arms 175 at pin joint 173 using standard mechanical fastening techniques known in the art. When the centralizer mechanism is assembled, the coil spring 160 is preloaded such that when the arms 170, 175 are in there extended position, as shown in FIG. 3, there is sufficient force transmitted to the pivoted arms of the plurality of centralizers to maintain the gun system 7 centralized in the casing 100. When the centralizer is moving through the tubing, the arms are compressed inwardly forcing the sliding cap 165 downward and further compressing the spring 160. As the centralizers pass through the bottom of the tubing 110, the spring 160 forces the cap 165 to slide upwards forcing the pivoted arms to extend outward into contact with the casing 100.

A firing head assembly 60 is attached to the topmost gun section 55*n*. The firing head assembly 60 comprises a firing head 40 and a centralizer 35. The centralizer 35 is adapted on its lower end to operatively attach to the top of gun section 55*n* and on its top end to operatively attach to firing head 40. Firing head 40 is a hydraulic pressure actuated type firing head of a kind known in the art and is adapted on its lower end to attach to centralizer 35, and on its upper end to attach to a slickline 130 for insertion and retrieval into the wellbore 5.

In operation, the bridge plug 10 is run through the small diameter tubing 110 and into the larger diameter casing 100 and set at the desired location using techniques known in the art. The bridge plug 10 uses internal hydraulic pressure to expand elastomeric elements into contact with the casing 100 with sufficient force so as to be able to support the weight of the stackable gun system 7. Once the bridge plug 10 is set, the lower gun section 50 is run in using a slickline 130. The lower gun is latched to the top of the bridge plug 10 and the slickline 130 is released and retracted to the surface using the reel 135. Next, the gun section 55*a* is run in and latched to the top of the lower gun section 50. Additional gun sections 55 are run in and latched onto the top of the previous gun 55 as is required for the particular formation. The topmost gun section 55*n* is attached to a pressure actuated firing head assembly 60 and is run in and operatively latched to the top of the gun string 7. In the preferred embodiment, a pressure actuated firing head of a type known in the art is used to initiate the firing. In another embodiment, electric wireline operated firing heads may be used to initiate firing. The firing of the firing head 40 causes sequential firing of each of the gun sections, such as 55*n*–55*a* and 50.

The bridge plug 10 includes an automatic release such that the bridge plug 10 internal pressure is released upon firing of the bottom gun section 50. This releases the bridge plug 10 from engagement with the wall of the casing 100 and allows the bridge plug 10 and gun system 7 to fall to the bottom of the wellbore 5 providing unimpeded flow through the just perforated casing 100.

The gun system 7 may be retrieved from the wellbore one gun section at a time by lowering a standard retrieval tool into the wellbore and connecting to the uppermost gun section so that this gun section may be raised out of the wellbore. The connections between the individual gun sections are spring adapted to release one section at a time. Each of the gun sections may be removed in the same manner.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A method of perforating a casing of a well below a smaller diameter production tubing string, comprising the steps of:

conveying a through tubing retrievable bridge plug through the production tubing string into the casing;

setting the through tubing retrievable bridge plug into engagement with the casing;

lowering a first perforating gun section through the tubing;

landing the first perforating gun section onto the through tubing retrievable bridge plug;

lowering at least one additional perforating gun section through the production tubing;

landing the first at least one additional perforating gun section onto the first perforating gun section;

lowering a firing head on to a top perforating gun section;

firing said perforating gun sections and perforating the casing;

releasing said through tubing retrievable bridge plug from engagement with the casing after firing the perforating gun sections; and retrieving the through tubing retrievable bridge plug from the casing through the production tubing.

2. The method of claim 1 further comprising the step of retrieving at least one of the perforating gun sections from the casing through the production tubing.

3. A well perforating apparatus for perforating a casing of a well below a smaller diameter production tubing string comprising:

a cased wellbore;

a production tubing disposed in said wellbore;

a through-tubing retrievable bridge plug engagable with a portion of a well casing below said production tubing for providing a gun support within the casing;

a plurality of perforating gun sections, wherein one of said gun sections is a lower gun section being supported by the through-tubing retrievable bridge plug, and the remainder of said gun sections being supported by an adjacent gun section; and a firing head for activating said gun sections.

4. The apparatus of claim 3, wherein the through-tubing retrievable bridge plug is adapted to release from engagement with the well casing after the lower gun section is fired.

5. The method of claim 1, further comprising centralizing at least one of said perforating gun sections in said casing by attaching at least one coil-spring actuated centralizer to said at least one perforating gun section.

6. The apparatus of claim 3, further comprising at least one coil-spring actuated centralizer for centralizing the plurality of gun sections in said casing.

* * * * *